US006203449B1

(12) United States Patent
Kenmi

(10) Patent No.: US 6,203,449 B1
(45) Date of Patent: Mar. 20, 2001

(54) METALLIC HOLLOW GOLF CLUB HEAD

(75) Inventor: Yoshinari Kenmi, Hyogo (JP)

(73) Assignee: Royal Collection Incorporated, Kobeshi (JP)

( * ) Notice: Subject to any disclaimer, the term of this patent is extended or adjusted under 35 U.S.C. 154(b) by 0 days.

(21) Appl. No.: 09/401,992

(22) Filed: Sep. 23, 1999

(30) Foreign Application Priority Data

Sep. 25, 1998 (JP) ..... 10-271098

(51) Int. Cl.[7] ..... A63B 53/04
(52) U.S. Cl. ..... 473/346; 473/350
(58) Field of Search ..... 473/324, 330, 473/331, 329, 345, 346, 349, 350

(56) References Cited

U.S. PATENT DOCUMENTS 572,436 * 12/1896 Mills .
4,511,145 * 4/1985 Schmidt .
4,635,941 * 1/1987 Yoneyama .
5,090,702 * 2/1992 Viste .
5,377,985 * 1/1995 Ohnishi .
5,533,729 * 7/1996 Leu .
5,611,742 * 3/1997 Kobayashi .
5,665,013 * 9/1997 Kobayashi .
5,676,605 * 10/1997 Kobayashi .
5,711,722 * 1/1998 Miyajima .
5,735,755 * 4/1998 Kobayashi .
5,908,357 * 6/1999 Hsieh .

FOREIGN PATENT DOCUMENTS 9-192273 7/1997 (JP) .
9-308713 12/1997 (JP) .

* cited by examiner

*Primary Examiner*—Sebastiano Passaniti
(74) *Attorney, Agent, or Firm*—Armstrong, Westerman, Hattori, McLeland & Naughton, LLP

(57) ABSTRACT

A metallic golf club head includes a face having a plurality of scoring lines formed horizontally on a front surface of the face within a sweet area thereof, and a plurality of reinforcing ridges formed on a rear surface of the face. A plurality of ridges are formed along the scoring lines. Preferably, each reinforcing ridge is positioned right behind the corresponding scoring line so as to compensate a decreased thickness of the face caused by forming the scoring line.

6 Claims, 4 Drawing Sheets

METALLIC HOLLOW GOLF CLUB HEAD

BACKGROUND OF THE INVENTION

1. Field of the Invention

This invention relates to a golf club head and, more particularly, to a metallic hollow golf club head which is generally called as a metal wood.

2. Description of the Related Art

Recently, a large-sized metallic hollow golf club head has been proposed in order to attain a large moment of inertia and a low center of gravity. In a case of so called wood-type golf club head, it is said that an appropriate weight of the golf club head is approximately 200 g for an average golf player. Therefore, it is required to enlarge a golf club head within the aforementioned weight limitations.

A proposal on this kind of conventional golf club head has been made by Japanese Patent Laid-open Publication No. Hei 9-192273. In this golf club head, in order to enlarge the golf club head without changing the weight, the central area of the face including a sweet spot, is formed to have a thickness enduring the impact caused when hitting a ball, and the peripheral area around the central area is formed to have a thickness thinner than that of the central area. This enhances a spring performance of the face as a whole.

Another proposal has been made by Japanese Patent Laid-open Publication No. Hei 9-308713. According to this proposal, in order to provide a large-sized golf club head with a sufficient strength, a plurality of ridges are provided on a rear surface of the face vertically and/or horizontally.

In the meantime, enlarging the size of the golf club head and thinning the thickness of the face remarkably enhances the repulsion force, thereby enabling a longer carry due to so-called spring effects of the face. Therefore, many golf players prefer to use this kind of golf club.

On the other hand, there is a tendency that the player's score is greatly influenced by the selection of the golf club rather than the practice or technique of the player. Accordingly, the U.S.G.A. (United States Golf Association) is now trying to revise the golf rules so as to clearly regulate the spring effects of a golf club head.

In detail, the U.S.G.A is now trying to eliminate the unclear conventional definition on an "excess spring effect" by defining a concrete measuring method for measuring a repulsion coefficient of a spring effect, or a concrete devise for measuring the same.

In view of the above-mentioned trend, the metallic golf club head proposed by Japanese Patent Laid-open Publication No. Hei 9-192273 may become an improper golf club head in view of the revised golf rules because of the excessive spring effect.

On the other hand, the metallic golf club head proposed by Japanese Patent Laid-open Publication No. Hei 9-308713 may have a higher center of gravity because of the plurality of ridges formed on the whole area of the face. This contradicts the requirement for lowering the center of gravity of the golf club head.

SUMMARY OF THE INVENTION

The present invention was conceived to overcome the above-described problems. It is an object of the present invention to provide a metallic golf club head which is capable of enlarging the head size and restraining the spring effect while keeping the mechanical strength of the face.

According to one aspect of the present invention, a metallic golf club head includes a face having a plurality of scoring lines formed horizontally on a front surface of the face, and a plurality of reinforcing ridges formed on a rear surface of the face within a sweet area thereof. The plurality of ridges are formed along the scoring lines.

It is preferable that each reinforcing ridge is positioned right behind the corresponding scoring line so as to compensate the partially decreased thickness of the face caused by forming the scoring line.

Although a plurality of reinforcing ridges may be formed along all of the scoring lines, if the face is divided into three zones, i.e., an upper zone, a middle zone and a lower zone, the reinforcing ridges are not always required to be formed in the lower zone.

It is preferable that the width of each reinforcing ridge falls within the range of from 1.0 to 3.5 mm, and the height thereof falls within the range of from 0.8 to 2.0 mm, because of the following reasons: if the width or height of the reinforcing ridge is lower than the respective lower limit, the reinforcing effect by the reinforcing ridge decreases. On the other hand, if the width or height exceeds the respective upper limit, the weight of the golf club head increases. More effective size of the reinforcing ridge may be decided within the aforementioned range, considering the materials and the thickness of the face, the depth and width of the scoring line and the intervals of the adjacent scoring lines, and the like.

It is preferable that the thickness of the face falls within the range of from 2.5 to 3.5 mm, and the thickness of the other portion, i.e., the crown, the sole, the toe and the neck, falls within the range of from 0.5 to 1.5 mm.

In this specification, the word "titanium" denotes a titanium and its alloy including a titanium as a main ingredient and an aluminum, a vanadium, or the like, as an additive. The word "sweet area" denotes an area including a center portion of the face and a portion around thereof by which 90% or more of the maximum carry is obtained.

BRIEF DESCRIPTION OF THE DRAWINGS

The above and other objects, features, and advantages of the present invention will be apparent from the following detailed description of the preferred embodiments with reference to the attached drawings, wherein.

DETAILED DESCRIPTION OF THE PREFERRED EMBODIMENTS

Preferred embodiments of the present invention will now be described, in detail, with reference to the accompanying drawings.

Figure 1:
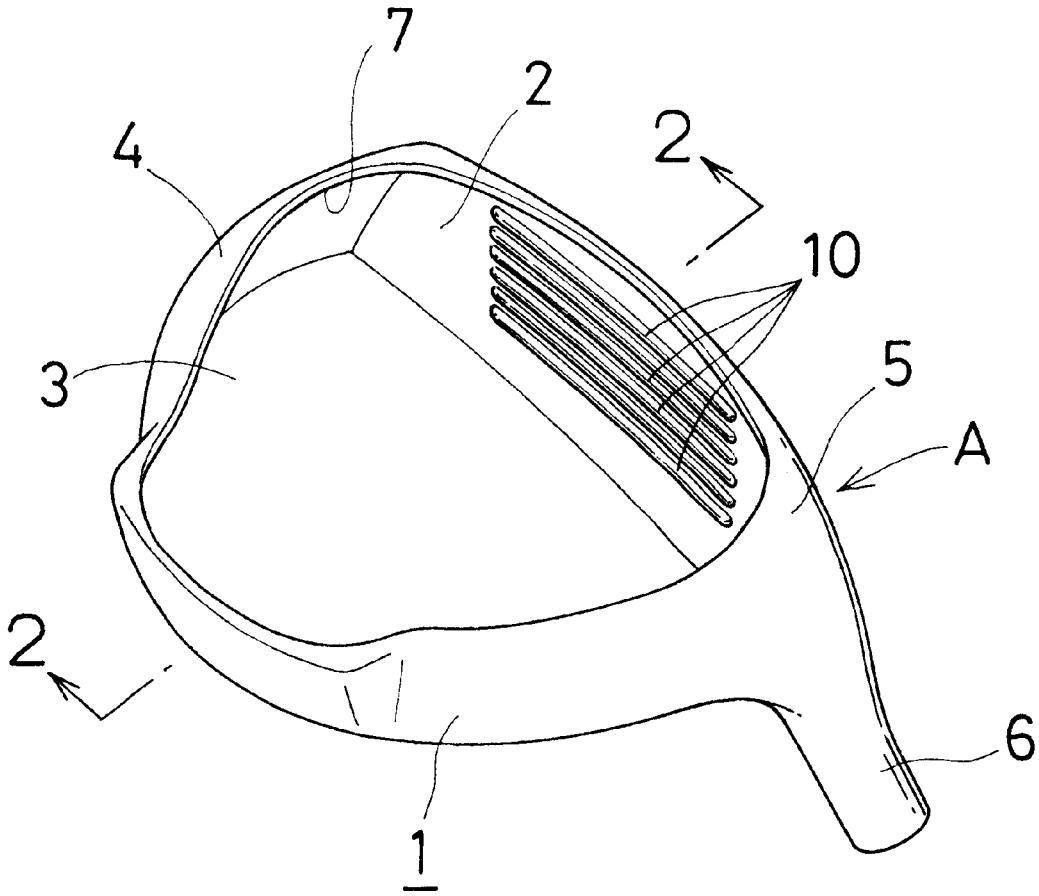
FIG. 1 is a reversed perspective view of the head main body of the metallic golf club head according to an embodiment of the present invention.
Figure 2A:
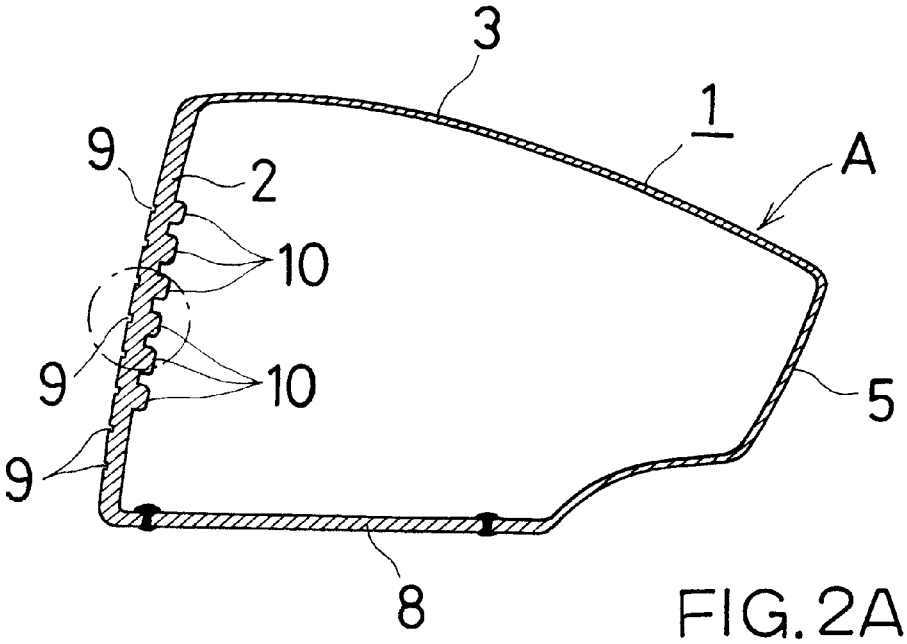
FIG. 2A is a reversed cross-sectional view of the golf club head taken along the line 2—2 of FIG. 1.
Figure 2B:
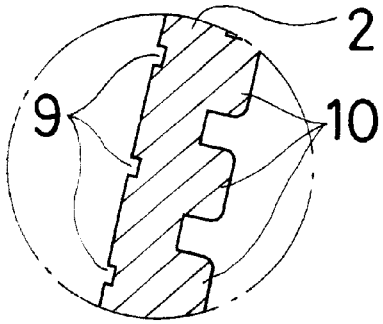
FIG. 2B is an enlarged view of the circled portion of FIG. 2A.
Figure 3:
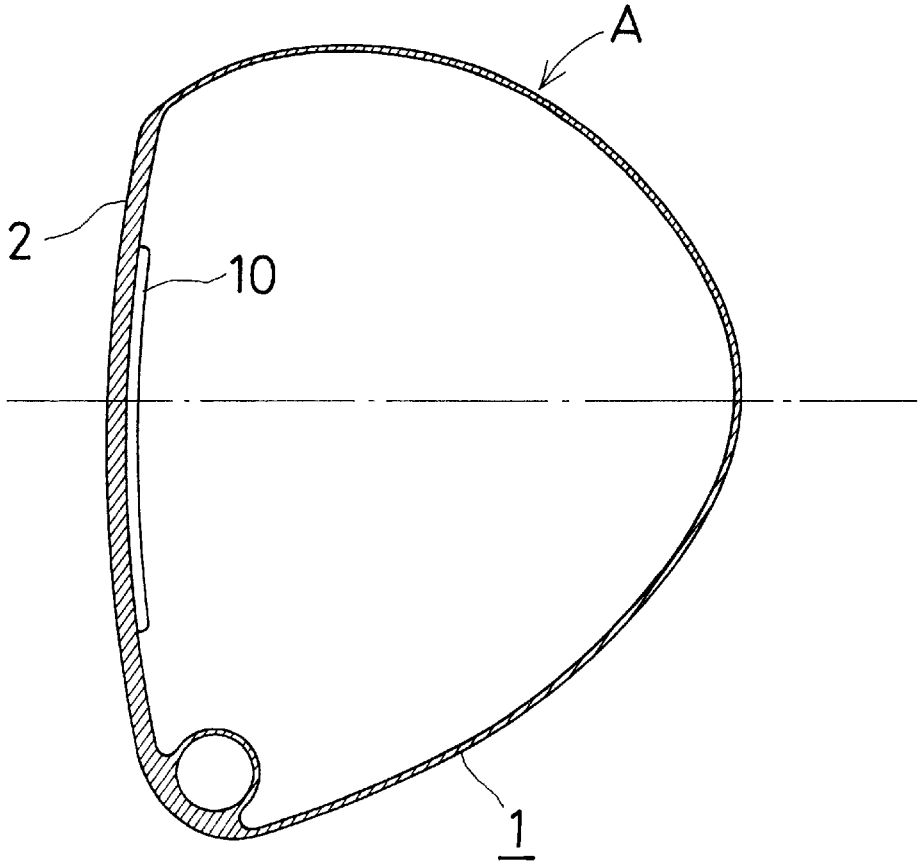
FIG. 3 is a horizontal cross-sectional view of the golf club head.

As shown in FIGS. 1, 2A and 2B, a wood-type golf club head A is comprised of a head main body 1 including a face 2, a crown 3, a toe 4, a heel 5 and a neck 6, and a sole 8 fitted in a opening 7 formed in the head main body 1 and welded to the head main body 1.

Both the head main body 1 and the sole 8 are made of stainless steel. The golf club head A is manufactured by integrally casting the head main body 1 having the opening 7 by a lost wax method, and fitting the sole 8 in the opening 7 and welding the sole 8 to the head main body 1. After the welding of the sole 8 to the head main body 1, a finish abrasion is performed to remove the excess welding materials. Thus, a predetermined hollow metallic golf club head A is obtained.

Alternatively, the golf club head A may be manufacturing by integrally casting a head main body having a face-fitting opening by a lost wax method, and fitting a face in the face-fitting opening and welding the face to the head main body.

The above-mentioned sole or head to be welded to the head main body may be formed by casting, rolling forging, or pressing.

The thickness of the face 2 is 2.6 mm, except for the portion where the reinforcing ridges 10, which will be mentioned later, are protruded. The thickness of the crown 3, the toe 4 and the heel 5 are 0.7 mm, and the thickness of the neck 6 is 1.45 mm.

In general, it is preferable that the thickness of the face 2 falls within the range of from 2.5 to 3.5 mm, and that the thickness of the portion other than the face 2 falls within the range of from 0.5 to 1.5 mm. In a case where the whole golf club head A is made of stainless steel, it is preferable that the thickness of the face 2 falls within the range of from 2.5 to 3.0 mm, and that the thickness of the portion other than the face 2 falls within the range of from 0.5 to 1.0 mm. It is more preferable that the thickness of the face 2 falls within the rage of from 2.6 to 2.7 mm, and that the thickness of the portion other than the face is 0.7 to 0.9 mm.

In a case where the whole golf club head is made of titanium, it is preferable that the thickness of the face 2 falls within the range of from 2.5 to 3.5 mm, and that the thickness of the portion other than the face 2 falls within the range of from 0.8 to 1.5 mm. It is more preferable that the thickness of the face 2 falls within the rage of from 2.8 to 3.1 mm, and that the thickness of the portion other than the face is 0.8 to 1.2 mm.

The face 2 is provided with a total of 8 (eight) scoring lines 9 formed thereon horizontally, i.e., generally parallel to the sole 8, at certain intervals in an up-and-down direction. The depth of each scoring line 9 is 0.3 mm, and the interval of the adjacent scoring lines is 4.5 mm.

As shown in FIG. 1, a plurality of reinforcing ridges 10 are protruded from the rear surface of the face 2 within a sweet area. As shown in FIG. 2A, these reinforcing ridges 10 are formed along the first to sixth scoring lines 9 from the uppermost one among the total of 8 (eight) scoring lines 10. The reason for not forming the reinforcing ridges 10 along the seventh and eighth scoring lines 10 is as follows. The impact caused when hitting a ball and imparted to the lower portion of the face 2 is remarkably small as compared to the upper and middle portion thereof. As is apparent from the above, in the present invention, the reinforcing ridges 10 may be formed along all of the scoring lines 9. However, if the face 2 is divided into three zones in an up-and-down direction, or an upper zone, a middle zone and a lower zone, the reinforcing ridges 10 may be formed only on the upper and middle zones.

As shown in FIG. 2B, the reinforcing ridge 10 is formed so as to be positioned right behind the corresponding scoring line 9. In other words, the longitudinal axial line of the reinforcing ridge 10 is positioned at the same level as that of the scoring line 9 so that the reinforcing ridge 10 compensates the partially decreased thickness of the face 2 caused by forming the scoring lines 9.

In general, it is preferable that the width of each reinforcing ridge falls within the range of from 1.0 to 3.5 mm, and the height thereof falls within the range of from 0.8 to 2.0 mm. In a case where the whole golf club head a is made of stainless steel, the thickness of the face 2 is set to be 2.6 mm, the depth of the scoring line 9 is set to be 0.3 mm, and the interval of the adjacent scoring lines 9 is set to be 4.5 mm, it is preferable that the width of each reinforcing ridge is 3.0 mm, and the height thereof is 1.5 mm.

Therefore, in this embodiment, the reinforcing ridge 10 is 3.0 mm in width and 1.5 mm in height.

Figure 4:
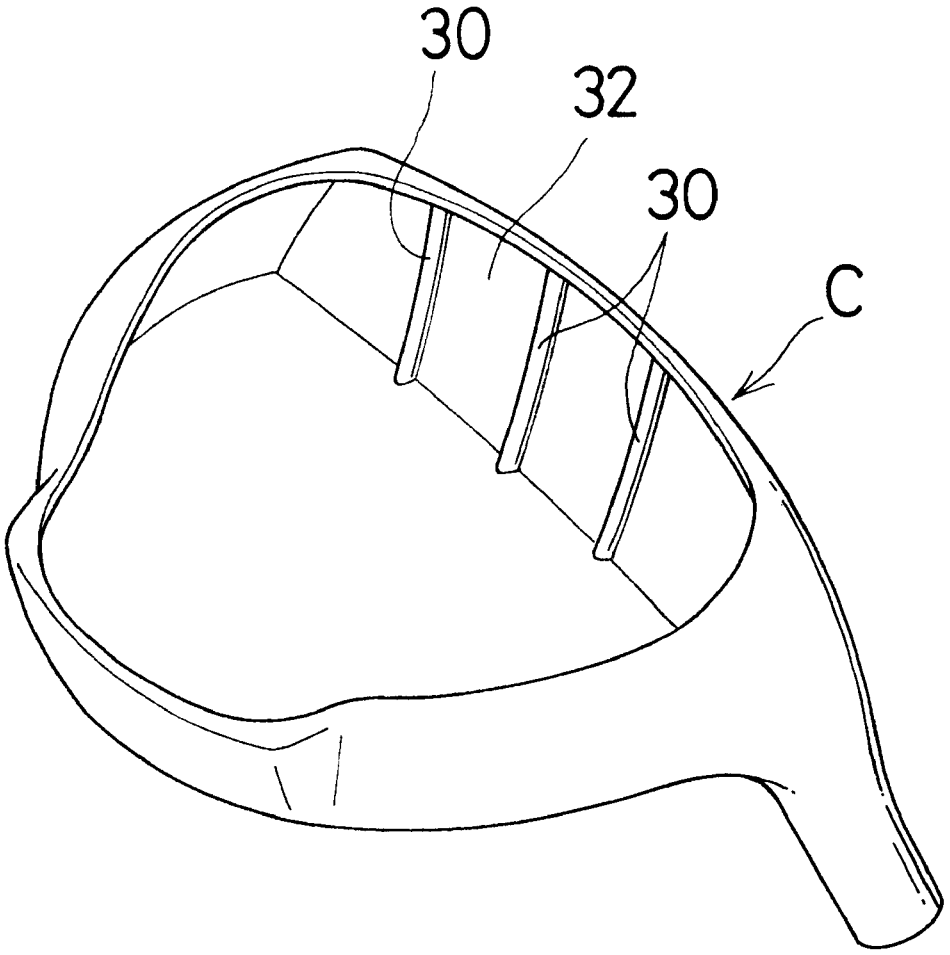
FIG. 4 (Related Art)
FIG. 4 is a reversed perspective view of the head main body of the metallic golf club head according to a related art.

In order to evaluate the strength of the golf club head A according to the aforementioned embodiment, the following strength test was conducted. In the test, a golf ball was thrown at and collided with the face 2 of the golf club head A at the initial velocity of 53 m/s (about 190 km/h) by using a golf ball throwing machine ("Air cannon (brand name)" manufactured by Birdmachine and Fabricating Corporation in U.S.A.). The test was repeated 500 (five hundred) times under the same conditions. Thereafter, the surface of the face 2 was observed by the naked eye, and no damage was found. On the other hand, the same strength test was performed to the golf club head C as shown in FIG. 4 which is similar to the golf club head A except that a plurality of ribs 30 are formed vertically on the rear surface of the face. The results revealed that only 40 (forty) collisions of golf balls caused a dented portion on the face which can be observed by the naked eye.

As mentioned above, the metallic golf club head according to the present invention includes a face having a plurality of scoring lines formed horizontally on a front surface of the face, and a plurality of reinforcing ridges formed on a rear surface of the face within a sweet area thereof, wherein the plurality of ridges are formed along the scoring lines. Therefore, the portion of the face which is weak in strength because of the partially decreased thickness of the face caused by forming the scoring line is reinforced by the reinforcing ridges. This enables the whole area of the face to be thinner, which enables an enlargement of the face and the other portion, resulting in a larger golf club head. Furthermore, the reinforcing ridge can restrain a repulsion of the thinned face so that the spring effects of the thinned face can be adjusted within a predetermined value.

In a case where the width of reinforcing ridge falls within the range of from 1.0 to 3.5 mm, and the height of reinforcing ridge falls within the range of from 0.8 to 2.0 mm, the decreased amount of materials caused by thinning the face exceeds the increased amount of materials required to form the reinforcing ridges, resulting in a decreased weight of the golf club head as a whole.

In a case where the thickness of the face falls within the range of from 2.5 to 3.5 mm, and that of the portion other than the face falls within the range of from 0.5 to 1.5 mm, the golf club head can be effectively lightened.

This application claims priority to Japanese Patent Application No. Hei 10-27198, filed on Sep. 25, 1998, the disclosure of its description, claims, drawings and abstract is incorporated by reference in its entirety.

The terms and expressions which have been employed herein are used as terms of description and not of limitation, and there is no intent, in the use of such terms and expressions, of excluding any of the equivalents of the features shown and described or portions thereof, but it is recognized that various modifications are possible which fall within the scope of the invention as claimed.

What is claimed is:

1. A metallic golf club head, comprising:

a front striking face having a sweet area;

a plurality of scoring lines formed horizontally on a front surface of said front striking face;

a plurality of reinforcing linear ridges formed on a rear surface of said front striking face so as not to extend beyond said sweet area, each of said plurality of reinforcing linear ridges being formed along and positioned right behind a corresponding one of said scoring lines; and a plurality of linear grooves each extending between said adjacent reinforcing linear ridges, whereby each of said plurality of linear grooves has the same length as a length of each of said plurality of reinforcing linear ridges.

2. The metallic golf club head as recited in claim 1, wherein each of said plurality of reinforcing linear ridges is positioned right behind a corresponding one of said scoring lines so as to compensate a decreased thickness of said front striking face caused by forming said scoring line.

3. The metallic golf club head as recited in claim 1, wherein said reinforcing linear ridges are formed on upper and middle zones of said front striking face.

4. The metallic golf club head as recited in claim 1, wherein a width of said reinforcing linear ridge falls within the range of from 1.0 to 3.5 mm, and a height of said reinforcing linear ridge falls within the range of from 0.8 to 2.0 mm.

5. The metallic golf club head as recited in claim 1, wherein a thickness of said front striking face falls within the range of from 2.5 to 3.5 mm, and that of the portion other than said front striking face falls within the range of from 0.5 to 1.5 mm.

6. A metallic golf club head, comprising:

a front striking face having a sweet area;

a plurality of scoring lines formed horizontally on a front surface of said front striking face;

a plurality of reinforcing linear ridges formed on a rear surface of said front striking face so as not to extend beyond said sweet area;

said plurality of reinforcing linear ridges formed along said scoring lines, each of said reinforcing linear ridges being positioned right behind a corresponding one of said scoring lines; and a plurality of linear grooves each extending between said adjacent reinforcing linear ridges, whereby each of said plurality of linear grooves has the same length as a length of each of said plurality of reinforcing linear ridges.

wherein a thickness of said front striking face falls within the range of from 2.5 to 3.5 mm, and that of the portion other than said front striking face falls within the range of from 0.5 to 1.5 mm, and wherein a width of said reinforcing linear ridge falls within the range of from 1.0 to 3.5 mm, and a height of said reinforcing linear ridge falls within the range of from 0.8 to 2.0 mm.

* * * * *